US006888080B2

(12) United States Patent
Sasaki

(10) Patent No.: US 6,888,080 B2
(45) Date of Patent: May 3, 2005

(54) SWITCHING DEVICE

(75) Inventor: Makoto Sasaki, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/423,351

(22) Filed: Apr. 25, 2003

(65) Prior Publication Data

US 2003/0201156 A1 Oct. 30, 2003

(30) Foreign Application Priority Data

Apr. 26, 2002 (JP) ..... 2002-127085

(51) Int. Cl.[7] ..... H01H 9/00

(52) U.S. Cl. ..... 200/339; 200/559; 200/553; 200/315

(58) Field of Search ..... 200/5 R, 5 A, 200/5 B, 1 R, 1 B, 310–317, 339, 553, 556–562

(56) References Cited

U.S. PATENT DOCUMENTS 5,258,593 A * 11/1993 Hayakawa ..... 200/315
5,510,583 A * 4/1996 Pescetto ..... 200/1 B
5,735,392 A * 4/1998 Shirasaka ..... 200/553
5,901,839 A * 5/1999 Sasaki et al. ..... 200/551
6,091,038 A * 7/2000 Murphy et al. ..... 200/563
6,388,220 B1 * 5/2002 Sasaki et al. ..... 200/537
6,610,945 B2 * 8/2003 Onodera ..... 200/315

FOREIGN PATENT DOCUMENTS

EP 1037228 A2 * 9/2000 ..... H01H/23/02

* cited by examiner

*Primary Examiner*—Elvin Enad
*Assistant Examiner*—M. Fishman
(74) *Attorney, Agent, or Firm*—Brinks Hofer Gilson & Lione

(57) ABSTRACT

At a position which is overlapped to a space defined between a plane of projection of a first manipulating member with respect to a PCB and a plane of projection of a second manipulating member with respect to the PCB, first and second switches are arranged. First and second portions to be manipulated of the first switch are projected from a switch casing such that the first and second portions to be manipulated of the first switch are pushed and manipulated by projections at back sides of pushing surfaces of the first and second manipulating members, and first and second portions to be manipulated of the second switch are projected from the switch casing such that the first and second portions to be manipulated of the second switch are pushed and manipulated by other projections at back sides of other pushing surfaces of the first and second manipulating members.

3 Claims, 4 Drawing Sheets

SWITCHING DEVICE

This application claims the benefit of priority to Japanese Patent Application 2002-127085, filed on Apr. 26, 2002.

BACKGROUND OF THE INVENTION

1. Field of the Invention

The present invention relates to a switching device having two rotatable manipulating members which are positioned in parallel in the rotary axis direction.

2. Description of Related Art

With respect to a conventional switching device, the explanation is made by taking a power window switching device which performs opening/closing manipulation of a power window of an automobile as an example.

On a door at a drivers seat of an automobile, a power window switching device is mounted. This power window switching device is served for opening/closing operation of respective windows, namely a left-front window, a right-front window, a left-rear window and a right-rear window, for example.

As the above-mentioned manipulating member, there has been known a manipulating member which is configured to be rotatable in both of normal and reverse directions while sandwiching a neutral position between normal and reverse positions, wherein the manipulating member is rotated in the normal direction when the manipulating member is pushed in the front end side and is rotated in the reverse direction when the manipulating member is pushed in the rear end side.

Further, four manipulating members are arranged such that two manipulating members are arranged at a front row and remaining two manipulating members are arranged at a rear row. At the left side of the front row, the manipulating member for performing opening/closing operation of the left front window is arranged, while at the right side of the front row, the manipulating member for performing opening/closing operation of the right front window is arranged. These two manipulating members are arranged in parallel in the rotary axis direction. Further, at the left side of the rear row, the manipulating member for performing opening/closing operation of the left rear window is arranged, while at the right side of the rear row, the manipulating member for performing opening/closing operation of the right rear window is arranged. These two manipulating members are also arranged in parallel in the rotary axis direction in the same manner as the manipulating members in the front row.

In the conventional power window switching device, seesaw switches which are manipulated by the manipulating members are provided to respective manipulating members.

The seesaw switch includes a tilting contact which is tiltably mounted and have first and second movable contacts respectively at both ends, a first fixed contact with which the first movable contact is brought into contact or from which the first movable contact is separated, a second fixed contact with which the second movable contact is brought into contact or from which the second movable contact is separated, a third fixed contact with which a tilting center of the tilting contact always stays in contact, rotary members which are provided rotatably in the normal and reverse directions while sandwiching a neutral position therebetween and manipulate tilting contact, and restoring means which restores the rotary members to the neutral position.

Manipulating members are fixed to the above-mentioned rotary members. That is, when a front end side of the manipulating member is pushed, the rotary member is rotated in the normal direction from the neutral position, the tilting contact is manipulated by the rotary member, and the first movable contact and the first fixed contact are brought into contact with each other. Further, when a rear end side of the manipulating member is pushed, the rotary member is rotated in the reverse direction from the neutral position, the tilting contact is manipulated, and the second movable contact and the second fixed contact are brought into contact with each other.

Further, the conventional power window switching device is configured such that when the first movable contact of the seesaw switch and the first fixed contact are brought into contact with each other, a signal which initiates operation to open the window is outputted, while when the second movable contact and the second fixed contact are brought into contact with each other, a signal which initiates operation to close the window is outputted.

The conventional power window switching device having such a constitution is operated in the following manner.

When the front end side of the manipulating member is pushed, in the seesaw switch, the rotary member is rotated in the normal direction together with the manipulating member and hence, the tiling contact is manipulated so as to bring the first movable contact into contact with the first fixed contact. Due to such a contact, a signal to initiate the window opening operation is outputted from the power window switching device.

On the other hand, when the rear end side of the manipulating member is pushed, in the seesaw switch, the rotary member is rotated in the reverse direction from the neutral position together with the manipulating member and hence, the tiling contact is manipulated by the rotary member so as to bring the second movable contact into contact with the second fixed contact. Due to such a contact, a signal to initiate the window closing operation is outputted from the power window switching device.

When the manipulating member is no more pushed, that is, when the pushing force is released, the manipulating member returns to the neutral position by the restoring means together with the rotary member. Here, the window is stopped at a position where the application of a pressing force to the manipulating member is released.

In the above-mentioned conventional power window switching device, on respective pushing surfaces disposed at a front end side and a rear end side of the manipulating member, for example, displays which display the pushing surfaces are formed.

The displays are formed along a center line in the rotary axis direction of the manipulating member and have transparency. Further, in the vicinity of the displays on a back side of the manipulating member (assuming the pushing surface as a front side), illumination elements such as LEDs (Light Emitting Diodes) are provided. These LEDs are held at given positions on the back side of the displays by terminals which are connected to a PCB (Printed Circuit Board). That is, the displays are designed to function as illuminators to show the position of the manipulating member when the inside of an automobile is dark.

Here, in a plane of projection of the manipulating member with respect to the PCB, a seesaw switch is mounted and a mounting space for the seesaw switch is overlapped to a plane of projection of the display with respect to the PCB. Accordingly, the above-mentioned terminals are arranged in a bent posture at positions away from a mounting space of a switch casing.

However, when bending working is applied to the terminals, there arises a drawback that the displacement of LEDs is liable to occur easily due to errors in the working. Accordingly, there has been a demand that the LEDs be mounted without providing the bending working to the terminal.

SUMMARY OF THE INVENTION

The present invention is made to respond to these requests and it is an object of the present invention to provide, in a switching device having two rotatable manipulating members positioned in parallel in the rotary axis direction, a switching device which can lower a rate of mounting space of a switch overlapped to a plane of projection of a manipulating member with respect to a PCB.

To achieve the above-mentioned object, according to a first aspect of the present invention, there is provided a switching device which includes first and second manipulating members which are rotatably mounted and are positioned in parallel in a rotary axis direction, a first switching portion which is manipulated by the first manipulating member, a second switching portion which is manipulated by the second manipulating member, a switch which is disposed at a position overlapped to a space which is formed between a plane of projection of the first manipulating member with respect to a substrate and a plane of projection of the second manipulating member with respect to the substrate, the switch having the first switching portion and the second switching portion, a first portion to be manipulated which projects into a movable range of the first manipulating member from a mounting range of a casing of the switch and turns on the first switching portion when manipulated by the first manipulating member, and a second portion to be manipulated which projects into a movable range of the second manipulating member from the mounting range of the casing and turns on the second switching portion when manipulated by the second manipulating member.

According to the first aspect of the present invention having such a constitution, the switch is disposed at the position overlapped to the space which is formed between the plane of projection of the first manipulating member with respect to the substrate and the plane of projection of the second manipulating member with respect to the substrate, the first portion to be manipulated is projected into the movable range of the first manipulating member from the mounting range of the switch casing, and the second portion to be manipulated is projected into the movable range of the second manipulating member from the mounting range of the switch casing. Accordingly, in the switching device having two rotatable manipulating members arranged in parallel in the rotary axis direction, a rate of mounting space of the switch overlapped to the plane of projection surfaces of the manipulating members with respect to the substrate can be decreased.

According to a second aspect of the present invention, in the above-mentioned first aspect of the present invention, the first and second portions to be manipulated are configured to be operated independently from each other.

In the second aspect of the present invention having such a constitution, it is possible to manipulate the first and second manipulating members simultaneously.

Further, according to a third aspect of the present invention, in the above-mentioned second invention, the first and second manipulating members are constituted of manipulating members which are operated in normal and reverse directions while sandwiching a neutral position, and the switch includes a first switch which is arranged such that the first portion to be manipulated is projected to a position at which the first portion to be manipulated is manipulated by the first manipulating member which is rotated in the normal direction within the movable range of the first manipulating member and is projected to a position at which the second portion to be manipulated is manipulated by the second manipulating member which is rotated in the normal direction within the movable range of the second manipulating member, and a second switch which is arranged such that the first portion to be manipulated is projected to a position at which the first portion to be manipulated is manipulated by the first manipulating member which is rotated in the reverse direction within the movable range of the first manipulating member and is projected to a position at which the second portion to be manipulated is manipulated by the second manipulating member which is rotated in the reverse direction within the movable range of the second manipulating member.

In the third aspect of the present invention having such a constitution, it is possible to perform two manipulations with respect to respective first and second manipulating members.

Further, according to a fourth aspect of the present invention, in the above-mentioned first aspect of the present invention, the switching device includes a light transmitter having transparency which is formed on at least one of the first and second manipulating members, an illumination element which illuminates the light transmitter from a back side of the manipulating member on which the light transmitter is formed, and a terminal which holds the illumination element at a given position on the back side of the manipulating member and electrically connects the illumination element to a circuit on the substrate.

In the fourth aspect of the present invention having such a constitution, it is possible to mount the illumination element while mounting the terminal linearly on the substrate as it is by making use of the spaces formed within the planes of projection of the respective first and second manipulating members with respect to the substrate.

DESCRIPTION OF PREFERRED EMBODIMENT

Figure 1:
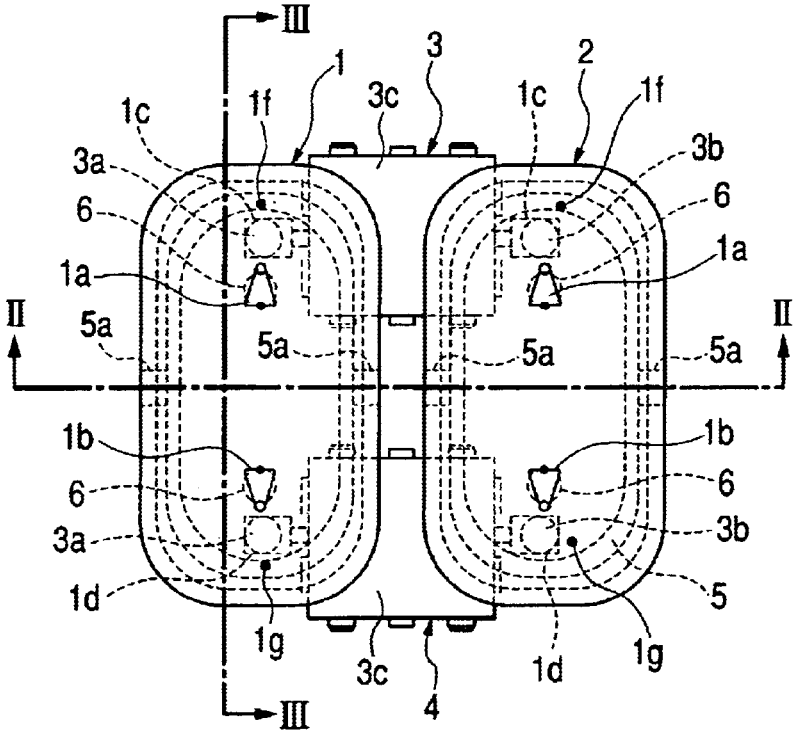
FIG. 1 is a plan view showing one embodiment of a switching device of the present invention.

One embodiment of a switching device of the present invention is explained in conjunction with the drawing.

Figure 2:
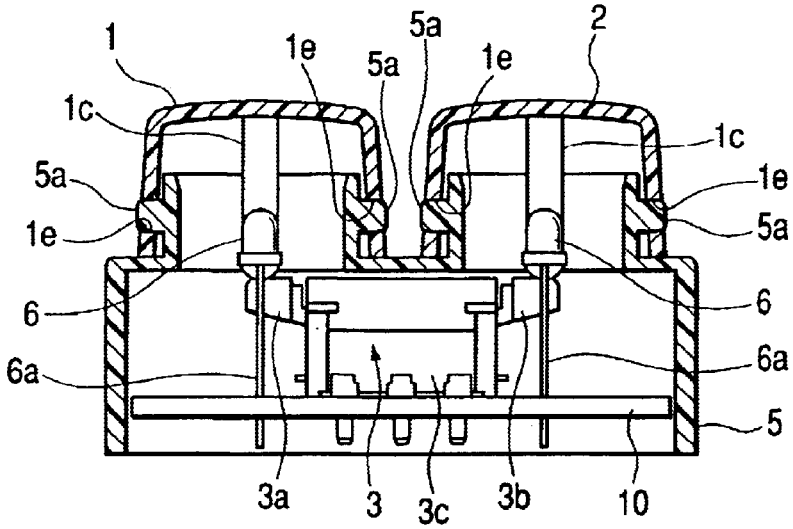
FIG. 2 is a cross-sectional view taken along a line II—II in FIG. 1.
Figure 3:
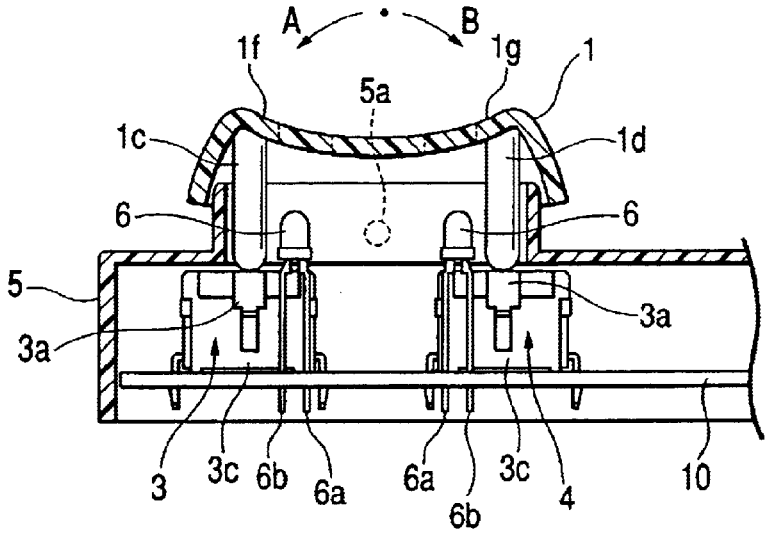
FIG. 3 is a cross-sectional view taken along a line III—III in FIG. 1.

FIG. 1 is a plan view showing one embodiment of a switching device of the present invention, FIG. 2 is a cross-sectional view taken along a line II—II in FIG. 1, FIG. 3 is a cross-sectional view taken along a line III—III in FIG.

Figure 4:
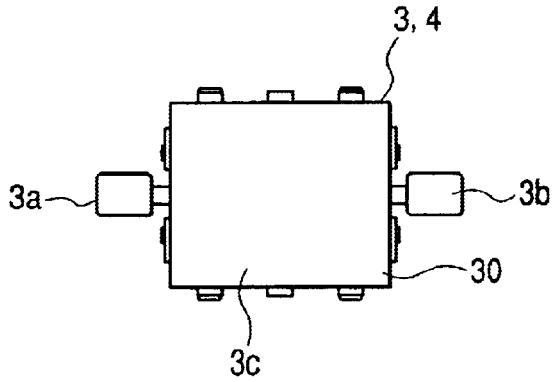
FIG. 4 is a plan view showing a switch provided to the embodiment shown in FIG. 1.
Figure 5:
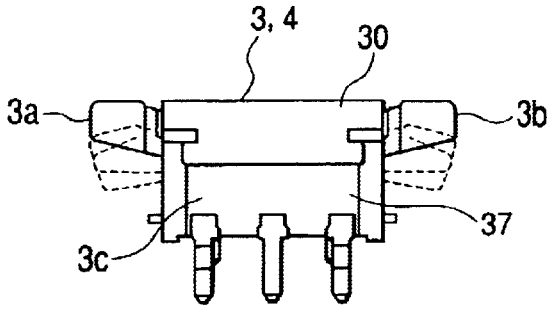
FIG. 5 is a front view of the switch shown in FIG. 4.
Figure 6:
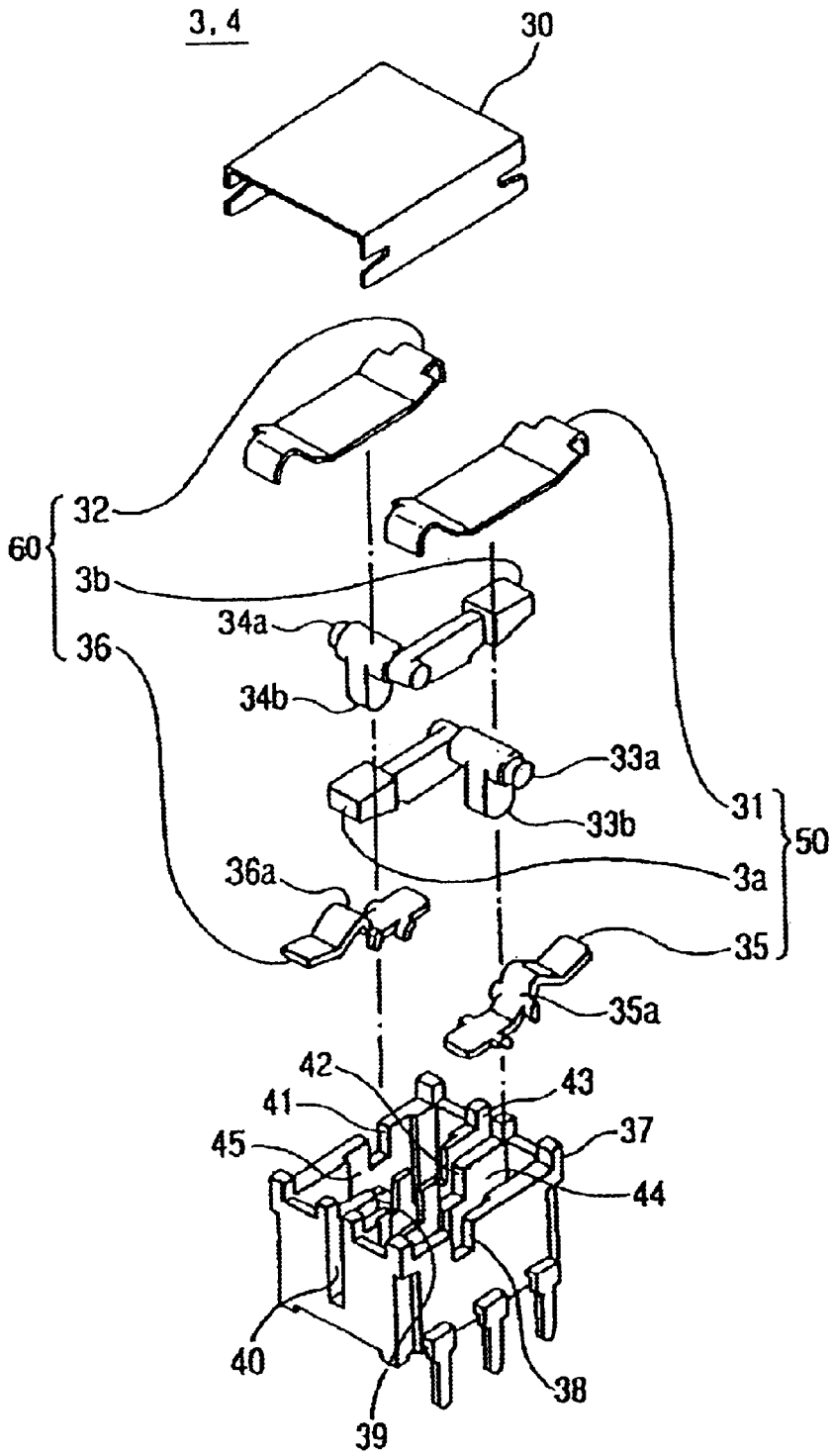
FIG. 6 is an exploded perspective view of the switch shown in FIG. 4.
Figure 7:
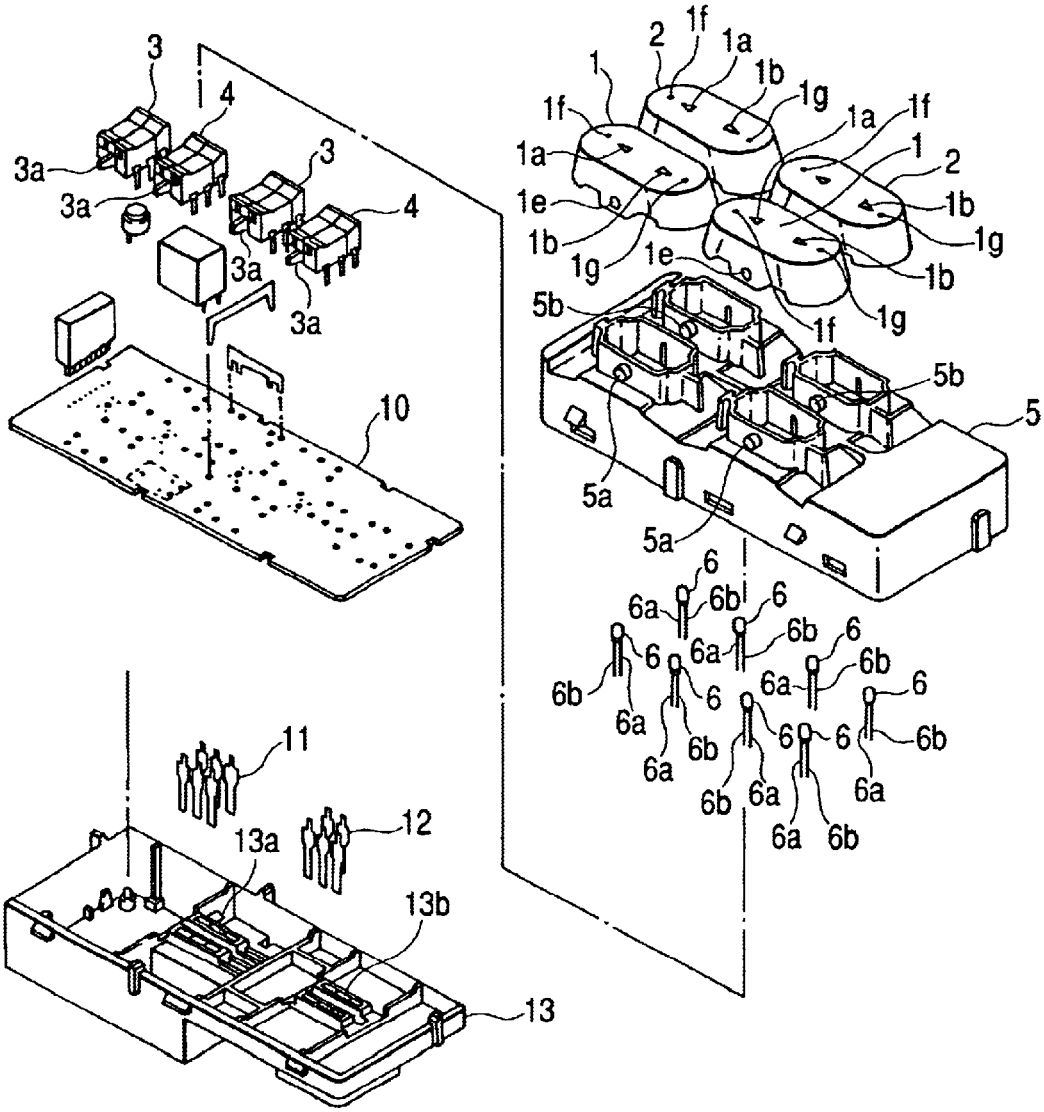
FIG. 7 is an exploded perspective view showing the embodiment provided to a power window switching device.

1, FIG. 4 is a plan view showing a switch provided to the embodiment shown in FIG. 1, FIG. 5 is a front view of the switch shown in FIG. 4, FIG. 6 is an exploded perspective view of the switch shown in FIG. 4, and FIG. 7 is an exploded perspective view showing the embodiment provided to a power window switching device.

The constitution of the switching device of this embodiment is explained hereinafter.

As shown in FIG. 1 to FIG. 3, the switching device of this embodiment includes first and second manipulating members 1, 2 which are rotatably mounted in normal and reverse directions, that is, directions A, B shown in FIG. 3 while sandwiching a neutral position. These first and second manipulating members 1, 2 include, as shown in FIG. 2, through holes 1*e* at centers of both left and right sides. By inserting support shafts 5*a* formed on a cover 5 into the through holes 1*e*, the cover 5 is rotatably supported. These first and second manipulating members 1, 2 are rotated in the direction A from the neutral position when a front-end-side pushing surface 1*f* is pushed, and is rotated in the direction B from the neutral position when a rear-end-side pushing surface 1*g* is pushed. In FIG. 1 to FIG. 3, the first and second manipulating members 1, 2 positioned at the neutral position are shown.

Further, as shown in FIG. 2 and FIG. 3, the first and second manipulating members 1, 2 mount rod-like projections 1*c*, 1*d* which are respectively projected downwardly on a back surface of the front-end-side pushing surface 1*f* and on a back surface of the rear-end-side pushing surface 1*g*. The projections 1*c*, 1*d* of the first manipulating member 1 are respectively brought into contact with upper surfaces of a first portion to be manipulated 3*a* of a first switch 3 and a first portion to be manipulated 3*a* of a second switch 4 which will be explained later respectively. Further, the projections 1*c*, 1*d* of the second manipulating member 2 are respectively brought into contact with upper surfaces of a second portion to be manipulated 3*b* of the first switch 3 and a second portion to be manipulated 3*b* of the second switch 4.

Returning now to FIG. 1, the switching device of this embodiment includes the first and the second switches 3, 4 which are disposed at positions which are overlapped to a space defined between a plane of projection of the first manipulating member 1 with respect to a PCB (Printed Circuit Board) 10 and a plane of projection of the second manipulating member 2 with respect to the PCB 10 and are positioned in parallel in the direction perpendicular to the rotary axis direction of the first and the second manipulating members 1, 2.

Here, the first and second switches 3, 4 are explained in conjunction with FIG. 4 to FIG. 6.

As shown in FIG. 6, in the first and second switches 3, 4, a switch casing 3*c* is constituted of an upper cover 30 and a lower casing 37. The lower casing 37 is partitioned to first and second chambers 44, 45. A first switching portion 50 is provided in the inside of the first chamber 44, while a second switching portion 60 is provided in the inside of the second chamber 45.

The first switching portion 50 includes the first portion to be manipulated 3*a* which is manipulated by pushing using the projection 1*c* or 1*d* of the first manipulating member 1, a movable contact 35 which is tiltably supported on the lower casing 37 and with which a projection 33*b* of the first portion to be manipulated 3*a* is brought into contact, a fixed contact not shown in the drawing with which the movable contact 35 is brought into contact or from which the movable contact 35 is removed, and a leaf spring 31 which pushes the first portion to be manipulated 3*a* to the movable contact 35 due to a spring force.

The first portion to be manipulated 3*a* is rotatably supported by disposing support shafts 33*a* in notches 38, 39 formed in the lower casing 37. As shown in FIG. 4 and FIG. 5, the first portion to be manipulated 3*a* is projected from a notch 40 formed in one of both side walls of the lower casing 37 disposed parallel to the rotary axis direction.

As shown in FIG. 6, the movable contact 35 includes an inclined surface 35*a* with which the projection 33*b* of the first portion to be manipulated 3*a* is brought into slide contact. This inclined surface 35*a* is provided for making the spring force of the leaf spring 31 act on the projection 33*b* of the first portion to be manipulated 3*a* as a repulsive force against the downward rotation of the first portion to be manipulated 3*a*. That is, a restoring means which restores the first portion to be manipulated 3*a* is constituted of the leaf spring 31 and the inclined surface 35*a*.

With respect to the first switching portion 50 having such a constitution, as shown in FIG. 5, when the first portion to be manipulated 3*a* is manipulated by pushing from above, the first portion to be manipulated 3*a* is rotated in the downward direction against the repulsive force received from the inclined surface 35*a* of the movable contact 35. Then, the movable contact 35 is brought into contact with the fixed contact in an interlocking manner with the rotation of the first portion to be manipulated 3*a* so that the first switching portion 50 is turned on. When the pushing force is removed from the first portion to be manipulated 3*a*, the first portion to be manipulated 3*a* is restored by the restoring means and hence, the movable contact 35 is moved away from the fixed contact whereby the first switching portion 50 is turned off.

The second switching portion 60 has substantially the same constitution as the first switching portion 50 and is provided in a staggered manner with respect to the first switching portion 50. That is, the second switching portion 60 includes the second portion to be manipulated 3*b* which is manipulated by pushing using the projection 1*c* or 1*d* of the second manipulating member 2, a movable contact 36 which is tiltably supported on the lower casing 37 and with which a projection 34*b* of the second portion to be manipulated 3*b* is brought into contact, a fixed contact not shown in the drawing with which the movable contact 36 is brought into contact or from which the movable contact 36 is removed, and a leaf spring 32 which pushes the second portion to be manipulated 3*b* to the movable contact 36 due to a spring force.

The second portion to be manipulated 3*b* is, in the same manner as the above-mentioned first portion to be manipulated 3*a*, rotatably supported by disposing support shafts 34*a* in notches 41, 42 formed in the lower casing 37. As shown in FIG. 4 and FIG. 5, the second portion to be manipulated 3*b* is projected from a notch 43 formed in a side wall which faces the side wall from which the first portion to be manipulated 3*a* is projected.

As shown in FIG. 6, in the same manner as the above-mentioned movable contact 35, the movable contact 36 includes an inclined surface 36*a* with which the projection 34*b* of the second portion to be manipulated 3*b* is brought into slide contact. This inclined surface 36*a* is provided for making the spring force of the leaf spring 32 act on the projection 34*b* of the second portion to be manipulated 3*b* as a repulsive force against the downward rotation of the second portion to be manipulated 3*b*. That is, a restoring means which restores the second portion to be manipulated 3*b* is constituted of the leaf spring 32 and the inclined surface 36*a*.

With respect to the second switching portion 60 having such a constitution, as shown in FIG. 5, in the same manner as the first switching portion 50, when the second portion to be manipulated 3*b* is manipulated by pushing from above, the second portion to be manipulated 3*b* is rotated in the downward direction against the repulsive force received from the inclined surface 36*a* of the movable contact 36. Then, the movable contact 36 is brought into contact with the second fixed contact in an interlocking manner with the rotation of the second portion to be manipulated 3*b* so that the second switching portion 60 is turned on. When a pushing force is removed from the second portion to be manipulated 3*b*, the second portion to be manipulated 3*b* is restored by the restoring means and hence, the movable contact 36 is moved away from the fixed contact whereby the second switching portion 60 is turned off.

Returning to FIG. 1 to FIG. 3, the first portion to be manipulated 3*a* of the first switch 3 is projected to a position where the first portion to be manipulated 3*a* is manipulated by pushing of the first manipulating member 1 which is rotated in the direction A within a movable range of the first manipulating member 1. That is, at the back side of the pushing surface 1*f* of the first manipulating member 1, an end of the projection 1*c* of the first manipulating member 1 is brought into contact with the upper surface of the first portion to be manipulated 3*a*.

Further, the second portion to be manipulated 3*b* of the first switch 3 is projected to a position where the second portion to be manipulated 3*b* is manipulated by pushing of the second manipulating member 2 which is rotated in the direction A within a movable range of the second manipulating member 2. That is, at the back side of the pushing surface 1*f* of the second manipulating member 2, an end of the projection 1*c* of the second manipulating member 2 is brought into contact with the upper surface of the second portion to be manipulated 3*b*.

Further, the first portion to be manipulated 3*a* of the second switch 4 is projected to a position where the first portion to be manipulated 3*a* is manipulated by pushing of the first manipulating member 1 which is rotated in the direction B within a movable range of the first manipulating member 1. That is, at the back side of the pushing surface 1*g* of the first manipulating member 1, an end of the projection 1*d* of the first manipulating member 1 is brought into contact with the upper surface of the first portion to be manipulated 3*a*.

Further, as shown in FIG. 1, the second portion to be manipulated 3*b* of the second switch 4 is projected to a position where the second portion to be manipulated 3*b* is manipulated by pushing of the second manipulating member 2 which is rotated in the direction B within a movable range of the second manipulating member 2. That is, at the back side of the pushing surface 1*g* of the second manipulating member 2, an end of the projection 1*c* of the second manipulating member 2 is brought into contact with the upper surface of the second portion to be manipulated 3*b*.

Further, in this embodiment, to the respective pushing surfaces 1*f*, 1*g* of the first manipulating member 1, displays 1*a*, 1*b* which indicate that they are pushing surfaces are provided. These displays 1*a*, 1*b* are formed along a center line in the rotary axis direction of the first manipulating members 1, 2. Further, to respective pushing surfaces 1*f*, 1*g* of the second manipulating member 2, in the same manner as the first manipulating member, the displays 1*a*, 1*b* are respectively provided.

These displays 1*a*, 1*b* include portions having transparency. On respective back sides of these displays 1*a*, 1*b*, illumination elements, that is, LEDs 6 which illuminate the respective displays 1*a*, 1*b* from back sides thereof are formed. The LEDs 6 are respectively held on the back side of the display 1*a* at positions where the LEDs 6 face the displays 1*a*, 1*b* by way of linear terminals 6*a*, 6*b* mounted on the PCB 10.

As shown in FIG. 1 to FIG. 3, the LEDs 6 and the terminals 6*a*, 6*b* are arranged in a space defined between the first portion to be manipulated 3*a* of the first switch 3 and the second portion to be manipulated 3*b* of the second switch 4 and in a space defined between the second portion to be manipulated 3*b* of the first switch 3 and the second portion to be manipulated 3*b* of the second switch 4.

In this manner, by attaching the LEDs 6 to the displays 1*a*, 1*b* respectively, when the ambient atmosphere of the first and the second manipulating members 1, 2 is dark, the displays 1*a*, 1*b* perform the function as an illumination which shows the positions of the first and the second manipulating member 1, 2.

The switching device of this embodiment having the above-mentioned constitution is mounted on a power window switching device, for example. Then, this power window switching device is explained in conjunction with FIG. 7.

The power window switching device shown in FIG. 7 is mounted on a door at a driver's seat and is provided with two switching devices of the above-mentioned embodiment. That is, a switching device for performing opening/closing operation of a left-front window and a light-front window and a switching device for performing opening/closing operation of a left-rear window and a right-rear window adopt the switching device of the above-mentioned embodiment.

This power window switching device is controlled such that, with respect to the first switch 3 which is manipulated by the first and second manipulating members 1, 2 of the front row, when the movable contact 35 of the first switching portion 50 is brought into contact with the fixed contact, a signal which initiates operation to open the left-front window is outputted, while when the movable contact 36 of the second switching portion 60 is brought into contact with the fixed contact, a signal which initiates operation to open the right-front window is outputted.

Further, the power window switching device is controlled such that, with respect to the second switch 4 which is manipulated by the first and second manipulating members 1, 2 of the front row, when the movable contact 35 of the first switching portion 50 is brought into contact with the fixed contact, a signal which initiates operation to close the left-front window is outputted, while when the movable contact 36 of the second switching portion 60 is brought into contact with the fixed contact, a signal which initiates operation to close the right-front window is outputted.

Further, the power window switching device is controlled such that, with respect to the first switch 3 which is manipulated by the first and second manipulating members 1, 2 of the rear row, when the movable contact 35 of the first switching portion 50 is brought into contact with the fixed contact, a signal which initiates operation to open the left-rear window is outputted, while when the movable contact 36 of the second switching portion 60 is brought into contact with the fixed contact, a signal which initiates operation to open the right-rear window is outputted.

Further, the power window switching device is controlled such that, with respect to the second switch 4 which is manipulated by the first and second manipulating members 1, 2 of the rear row, when the movable contact 35 of the first switching portion 50 is brought into contact with the fixed contact, a signal which initiates operation to close the left-rear window is outputted, while when the movable contact 36 of the second switching portion 60 is brought into contact with the fixed contact, a signal which initiates operation to close the right-rear window is outputted.

Further, in this power window switching device, in addition to the first and second switches 3, 4 and LEDs 6, parts such as relays and the like are mounted on a surface of the PCB 10. Further, on a back surface of the PCB 10, external terminal groups 11, 12 which are exposed from a lower cover 13 are formed. Through holes 13*a*, 13*b* which allow the external terminal groups 11, 12 to pass therethrough are formed in the lower cover 13.

The manner of operation of the power switching device having such a constitution is explained by taking a case (1) in which the first manipulating member 1 of the front row is manipulated and a case (2) in which the second manipulating member 2 of the front row is manipulated as examples.

(1) When the First Manipulating Member 1 is Manipulated

When the pushing surface 1*f* at the front end side of the first manipulating member 1 is pushed, the first manipulating member 1 is rotated in the direction A from the neutral position. Here, in the first switching portion 50 of the first switch 3, the first portion to be manipulated 3*a* is manipulated by pushing using the projection 1*c* of the first manipulating member 1 so that the first portion to be manipulated 3*a* is rotated downwardly. The movable contact 35 is brought into contact with the first fixed contact in an interlocking manner with the rotation of the first portion to be manipulated 3*a* and hence, the first switching portion 50 is turned on. Accordingly, a signal which initiates operation to open the left-front window is outputted from the power window switching device.

When the pushing force is removed from the pushing surface 1*f* of the first manipulating member 1, the first portion to be manipulated 3*a* of the first switch 3 restores its original position due to the restoring means. Here, the projection 1*c* is pushed by the first portion to be manipulated 3*a* from below and hence, the first manipulating member 1 returns to the neutral position. Accordingly, in the first switching portion 50 of the first switch 3, the movable contact 35 is separated from the fixed contact so that the first switching portion 50 is turned off.

Further, when the pushing surface 1*g* at the rear end side of the first manipulating member 1 is pushed, the first manipulating member 1 is rotated in the direction B from the neutral position. Here, in the first switching portion 50 of the second switch 4, the first portion to be manipulated 3*a* is manipulated by pushing using the projection 1*d* of the first manipulating member 1 so that the first portion to be manipulated 3*a* is rotated downwardly. The movable contact 35 is brought into contact with the fixed contact in an interlocking manner with the rotation of the first portion to be manipulated 3*a* and hence, the second switching portion 60 is turned on. Accordingly, a signal which initiates operation to close the left-front window is outputted from the power window switching device.

When the pushing force is removed from the pushing surface 1*g* of the first manipulating member 1, the first portion to be manipulated 3*a* of the second switch 4 restores its original position due to the restoring means. Here, the projection 1*d* is pushed by the first portion to be manipulated 3*a* from below and hence, the first manipulating member 1 returns to the neutral position. Accordingly, in the first switching portion 50 of the second switch 4, the movable contact 35 is separated from the fixed contact so that the first switching portion 50 is turned off.

(2) When the Second Manipulating Member 2 is Manipulated

When the pushing surface 1*f* at the front end side of the second manipulating member 2 is pushed, the second manipulating member 2 is rotated in the direction A from the neutral position. Here, in the second switching portion 60 of the first switch 3, the second portion to be manipulated 3*b* is manipulated by pushing using the projection 1*c* of the second manipulating member 2 so that the second portion to be manipulated 3*b* is rotated downwardly. The second movable contact 36 is brought into contact with the second fixed contact in an interlocking manner with the rotation of the second portion to be manipulated 3*b* and hence, the second switching portion 60 is turned on. Accordingly, a signal which initiates operation to open the right-front window is outputted from the power window switching device.

When the pushing force is removed from the pushing surface 1*f* of the second manipulating member 2, the second portion to be manipulated 3*b* of the first switch 3 restores the original position due to the restoring means. Here, the projection 1*c* is pushed by the second portion to be manipulated 3*b* from below and hence, the second manipulating member 2 returns to the neutral position. Accordingly, in the second switching portion 60 of the first switch 3, the movable contact 36 is separated from the fixed contact so that the second switching portion 60 is turned off.

Further, when the pushing surface 1*g* at the rear end side of the second manipulating member 1 is pushed, the second manipulating member 2 is rotated in the direction B from the neutral position. Here, in the second switching portion 60 of the second switch 4, the second portion to be manipulated 3*b* of the second switch 4 is manipulated by pushing using the projection 1*d* of the second manipulating member 2 so that the second portion to be manipulated 3*b* is rotated downwardly. The second movable contact 36 is brought into contact with the second fixed contact in an interlocking manner with the rotation of the second portion to be manipulated 3*b* and hence, the second switching portion 60 is turned on. Accordingly, a signal which initiates operation to close the right-front window is outputted from the power window switching device.

When the pushing force is removed from the pushing surface 1*g* of the second manipulating member 2, the second portion to be manipulated 3*b* of the second switch 4 restores the original position due to the restoring means. Here, the projection 1*d* is pushed by the second portion to be manipulated 3*b* from below and hence, the second manipulating member 2 returns to the neutral position. Accordingly, in the second switching portion 60 of the second switch 4, the movable contact 36 is separated from the fixed contact so that the second switching portion 60 is turned off.

Here, when the first manipulating member 1 of the rear row is pushed and manipulated, a signal which performs an operation to open or close the left-rear window is outputted from the power window switching device. Further, when the second manipulating member 2 of the rear row is pushed and manipulated, a signal which performs an operation to open or close the right-rear window is outputted. In this case, the manner of operation of the first and second switches 3, 4 manipulated by the first and second manipulating members 1, 2 of the rear row is equal to that of the above-mentioned cases (1), (2).

Following advantageous effects can be obtained by the above-mentioned embodiment.

In the space defined between the plane of projection of the first manipulating member 1 with respect to the PCB 10 and the plane of projection of the second manipulating member 2 with respect to the PCB 10, the first switch 3 and the second switch 4 are arranged. The first and second portions to be manipulated 3*a*, 3*b* of the first switch 3 are respectively projected such that the first and second portions to be manipulated 3*a*, 3*b* are pushed and manipulated by the respective projections 1*c* of the first and second manipulating members 1, 2, and the first and second portions to be manipulated 3*a*, 3*b* of the second switch 4 are respectively projected such that the first and second portions to be manipulated 3*a*, 3*b* are pushed and manipulated by the respective projections 1*d* of the first and second manipulating members 1, 2. Accordingly, the rate of mounting spaces for switches overlapped to the planes of projection of the first and second manipulating members 1, 2 with respect to the PCB 10 can be lowered, whereby it is possible to enhance the freedom of the arrangement of parts in the planes of projection of the first and second manipulating members 1, 2 with respect to the PCB 10 compared to the related art.

Further, in this embodiment, since the first and second switches 3, 4 are arranged in the above-mentioned manner, it is possible to define the space between the first portion to be manipulated 3*a* of the first switch 3 and the first portion to be manipulated 3*a* of the second switch 4 and, at the same time, it is possible to define the space between the second portion to be manipulated 3*b* of the first switch 3 and the second portion to be manipulated 3*b* of the second switch 4. Further, the LEDs 6 are arranged by making use of these spaces. Accordingly, it is possible to arrange the LEDs 6 on the PCB 10 in a straight state without bending the terminals 6*a*, 6*b* of the LEDs 6 and hence, a problem that the LEDs 6 are displaced due to bending working of terminals can be solved.

Further, in this embodiment, the example in which the LEDs 6 are provided to the displays 1*a*, 1*b* respectively is explained. However, the present invention is not limited to such a case. That is, the LEDs 6 may be arranged at the center within the plane of projection of the first manipulating member 1 with respect to the PCB 10 and at the center within the plane of projection of the second manipulating member 2 with respect to the PCB 10. Due to such a constitution, the number of parts can be reduced.

Further, this embodiment has been explained in conjunction with a case in which two manipulating members 1, 2 are configured to be rotated in the directions A, B while sandwiching the neutral position, and two switches 3, 4 are provided to these two manipulating members 1, 2 so as to enable two operations per one manipulating member. However, the present invention is not limited to such a case. That is, the first and second manipulating members may be configured to be rotated only in one direction and only one switch similar to the switches 3, 4 may be provided to the manipulating members. In such a constitution, one manipulating member can perform only one manipulation and hence, such a constitution is not applicable to the above-mentioned power window switching device. However, it is possible to apply such a constitution to another switching device. In this case, the degree of freedom in the arrangement of parts within a plane of projection with respect to a substrate of the manipulating member can be enhanced in the switching device.

Further, with respect to the first and second switching portions 50, 60, this embodiment is explained in conjunction with the example in which the first and second members to be manipulated 3*a*, 3*b* which are rotated independently from each other are used. However, the present invention is not limited to such an example. That is, the first and second manipulating members 3*a*, 3*b* may be integrally formed like a seesaw switch. With the provision of such a constitution, although it is impossible to simultaneously manipulate the first and the second manipulating members 1, 2, the freedom of arrangement of parts in the plane of projection of the manipulating members with respect to the substrate can be enhanced.

To briefly recapitulate the advantageous effects obtained by the present invention, they are as follows.

According to the first aspect of the present invention, the switch is disposed at the position overlapped to the space which is formed between the plane of projection of the first manipulating member with respect to the substrate and the plane of projection of the second manipulating member with respect to the substrate, the first portion to be manipulated is projected into the movable range of the first manipulating member from the mounting range of the switch casing, and the second portion to be manipulated is projected into the movable range of the second manipulating member from the mounting range of the switch casing. Accordingly, in the switching device having two rotatable manipulating members in which two manipulating members are arranged in parallel in the rotary axis direction, a rate of mounting space for the switch overlapped to the projection surfaces of the manipulating members with respect to the substrate can be decreased. Accordingly, the degree of freedom of the arrangement of parts in a projection view of the first and second manipulating members with respect to the substrate.

According to a second aspect of the present invention, the first and second portions to be manipulated are operated independently from each other and hence, it is possible to manipulate the first and second manipulating members simultaneously whereby the operability of the switching device can be enhanced.

Further, according to a third aspect of the present invention, the first and second manipulating members are constituted of a manipulating member which is operated in the normal and reverse directions while sandwiching a neutral position. A first switch which is arranged such that the first portion to be manipulated is projected to a position at which the first portion to be manipulated is manipulated by the first manipulating member which is rotated in the normal direction within the movable range of the first manipulating member and is projected to a position at which the second portion to be manipulated is manipulated by the second manipulating member which is rotated in the normal direction within the movable range of the second manipulating member. Further, a second switch which is arranged such that the first portion to be manipulated is projected to a position at which the first portion to be manipulated is manipulated by the first manipulating member which is rotated in the reverse direction within the movable range of the first manipulating member and is projected to a position at which the second portion to be manipulated is manipulated by the second manipulating member which is rotated in the reverse direction within the movable range of the second manipulating member. Accordingly, it is possible to perform two manipulations with respect to respective first and second manipulating members whereby the application of the switching device can be broadened.

Further, according to a fourth aspect of the present invention, the switching device includes the light transmitter which has transparency which is formed on at least one of the first and second manipulating members, the illumination element which illuminates the light transmitter from the back side of the manipulating member on which the light transmitter is formed, and the terminal which holds the illumination element at a given position on the back side of the manipulating member and electrically connects the illumination element to a circuit on the substrate. Accordingly, it is possible to mount the illumination element while mounting the terminal linearly on the substrate as it is by making use of the spaces formed within the planes of projection of the respective first and second manipulating members with respect to the substrate. Accordingly, the positional displacement of the illuminating element which may occur due to errors in bending working of terminals can be obviated.

What is claimed is:

1. A switching device comprising:

a first manipulating member rotatably mounted and having a first pushing surface on a top thereof at a first end in a direction perpendicular to a rotational axis of the first manipulating member and a first pushing portion provided behind the first pushing surface;

a second manipulating member positioned adjacent to the first manipulating member, rotatably mounted such that a rotational axis of the second manipulating member is parallel to the rotational axis of the first manipulating member and having a second pushing surface on a top thereof at a first end in a direction perpendicular to the rotational axis of the second manipulating member and a second pushing portion provided behind the second pushing surface; and a first switch including a first switching portion having a first manipulated portion pressed by the first pushing portion, a first movable contact driven by the first manipulated portion, and a first fixed contact with which the first movable contact comes into contact; a second switching portion having a second manipulated portion pressed by the second pushing portion, a second movable contact driven by the second manipulated portion, and a second fixed contact with which the second movable contact comes into contact; and a first casing accommodating the first and second movable contacts, wherein the first casing is overlapped by the first and second manipulating members when viewed from above, and the first and second manipulated portions project from the first casing and are in contact with the first and second pushing portions, respectively wherein the first and second manipulating members have third and fourth pushing surfaces respectively, at a second end in the direction perpendicular to the rotational axes and third and fourth pushing portions provided behind the third and fourth pushing surfaces respectively;

a second switch is positioned adjacent to the first switch along the direction perpendicular to the rotational axis of the first manipulating member, the second switch includes a third switching portion having a third manipulated portion pressed by the third pushing portion, a third movable contact driven by the third manipulated portion, and a third fixed contact with which the third movable contact comes into contact; a fourth switching portion having a fourth manipulated portion pressed by the fourth pushing portion, a fourth movable contact driven by the fourth manipulated portion, and a fourth fixed contact with which the fourth movable contact comes into contact; and a second casing accommodating the third and fourth movable contacts, wherein the second casing is overlapped by the first and second manipulating members when viewed from above, and the third and fourth manipulated portions project from the second casing and are in contact with the third and fourth pushing portions respectively.

2. A switching device according to claim 1, wherein the first and second portions to be manipulated are independently operable.

3. A switching device according to claim 1, wherein the switching device comprises a light transmitter having transparency which is formed on at least one of the first and second manipulating members, an illumination element which illuminates the light transmitter from a back side of the manipulating member on which the light transmitter is formed, and a terminal which holds the illumination element at a given position on the back side of the manipulating member and electrically connects the illumination element to a circuit on the substrate.

* * * * *